US005746350A

United States Patent [19]

Nishigami et al.

[11] Patent Number: 5,746,350

[45] Date of Patent: May 5, 1998

[54] PUMP DEVICE FOR A CONTAINER

[75] Inventors: Akira Nishigami; Tsugio Arai, both of Ibaraki, Japan

[73] Assignee: Yoshino Kogyosho Co., Ltd., Tokyo, Japan

[21] Appl. No.: 564,096

[22] PCT Filed: Apr. 14, 1995

[86] PCT No.: PCT/JP95/00735

§ 371 Date: Dec. 18, 1995

§ 102(e) Date: Dec. 18, 1995

[87] PCT Pub. No.: WO95/28336

PCT Pub. Date: Oct. 26, 1995

[30] Foreign Application Priority Data

| | | | |
|---|---|---|---|
| Apr. 14, 1994 | [JP] | Japan | 6-075755 |
| Jun. 17, 1994 | [JP] | Japan | 6-135854 |
| Dec. 9, 1994 | [JP] | Japan | 6-306515 |

[51] Int. Cl.[6] ..... B65D 77/06; B65D 83/00

[52] U.S. Cl. ..... 222/95; 222/105; 222/321.9; 222/382; 222/464.2

[58] Field of Search ..... 222/95, 105, 183, 222/211, 382, 464.1, 464.2, 321.1, 321.7, 321.9, 385

[56] References Cited

U.S. PATENT DOCUMENTS

| | | | |
|---|---|---|---|
| 3,876,115 | 4/1975 | Venus, Jr. et al. | 222/183 |
| 4,286,636 | 9/1981 | Credle | 141/65 X |
| 4,322,020 | 3/1982 | Stone | 222/105 X |
| 5,156,300 | 10/1992 | Spahni et al. | 222/491 X |
| 5,513,761 | 5/1996 | Kobayashi et al. | 222/183 X |

FOREIGN PATENT DOCUMENTS

| | | |
|---|---|---|
| A-5-319467 | 12/1993 | Japan . |
| A-5-319468 | 12/1993 | Japan . |
| Y2-7-28060 | 6/1995 | Japan . |

*Primary Examiner*—Kevin P. Shaver
*Attorney, Agent, or Firm*—Oliff & Berridge PLC

[57] ABSTRACT

A pump device for a container that is capable of pouring substantially the whole quantity of contents. The pump device includes an operating portion exposed to an outside of the container, a suction portion having a flange attached to the mouth of the container and a lower end inserted into the container for sucking out the contents of a contents filled sealed bag from a suction port, and a gap holding rod having a proximal end internally fitted into the section portion and a distal end extending toward an inner bottom portion of a contents filled sealed bag. The suction portion includes a plurality of cylindrical portions of decreasing diameter starting below the flange. First and second protruded and recessed portions are provided on separate cylindrical portions and third protruded and recessed portions are provided on an outer peripheral surface of the gap holding rod.

2 Claims, 15 Drawing Sheets

PUMP DEVICE FOR A CONTAINER

TECHNICAL FIELD

The present invention relates generally to a pump device for a container and, more particularly, to a pump device for a container which is capable of pouring substantially the whole quantity of contents to the very last content.

BACKGROUND OF THE INVENTION

FIG. 30 illustrates a known container for pouring out contents having a high viscosity or altered upon a contact with the outside air with a fixed quantity.

This container 1 includes a flexible content-filled sealed bag housed in the interior thereof, and a pump 4 is mounted in a mouth cylindrical portion 3. This pump 4 is equipped with an operating portion 5 exposed to the outside of the container 1 and a suction portion 6 inserted into the sealed bag 2. The suction portion 6 taking a pipe-like shape is formed with a suction port 6*a* opened at a front edge thereof and extends to an area in the vicinity of a bottom of the sealed bag 2.

In this container 1, after the operating portion 5 has been moved downward, this operating portion 5 rises due to a spring back, with the result that the interior of the suction portion 6 is under a negative pressure. Contents 7 in the sealed bag 2 are thereby sucked via the suction port 6*a* into the pump. When the operating portion 5 is again lowered, the contents sucked into the pump are poured out of a discharge port 5*a* formed in the operating portion 5. Thus, all the contents 7 in the sealed bag 2 can be poured out by sequentially sucking them.

According to the conventional container, however, though there would be no problem at the beginning of its use, when the contents 7 are reduced, the sealed bag 2 is closely fitted to the suction portion 6. Then, it follows that the suction port 6*a* of the suction portion 6 is blockaded, and the contents 7 can not be sucked. For this reason, there arises a problem in which the pump can not be completely restored, and the contents 7 are left.

Further, because of the sealed bag 2 being closely fitted to the suction portion 6, the contents 7 existing in an upper area of the sealed bag 2 are hindered from flowing up to the suction port 6*a* of the suction portion 6, and it follows that the contents 7 stay in the upper area due to a local shrinkage of the bottom of the sealed bag 2 in combination therewith. Thus, it is uneconomical that the contents 7 stay in the upper area of the sealed bag 2.

SUMMARY OF THE INVENTION

It is a primary object of the present invention, which was devised in view of the above problems inherent in the prior art, to provide a pump device for a container that exhibits an excellent productivity and is capable of smoothly surely pouring out contents by preventing a suction port of a sealed bag from being blockaded and, besides, pouring out the whole quantity of contents.

To obviate the problem given above, the present invention adopts the following construction.

More specifically, in a pump device for a container, the pump device has an operating portion exposed to the outside of the container and a suction portion, inserted into the container, for sucking the contents out of a suction port. The pump device for the container further comprises a gap holding rod including a proximal end internally fitted into the suction port of the suction portion and a distal end extending toward an inner bottom portion of the contents-filled sealed bag. Protruded portions and recessed portions extending from the proximal end of the gap holding rod toward the distal end thereof are formed alternately in a circumferential direction on an outer peripheral surface of the gap holding rod.

The gap holding rod is constructed such that at least all outermost side of the outermost-positioned protruded portion outermost sides of each of the protruded portions are in the shape of outwardly-convex circular arcs or straight lines.

In the container (corresponding to an innermost layer in a so-called laminated container) having the contents-filled sealed bag contracting with the internal negative-pressurization when taking out the contents, the interior of the container is depressurized as the contents are poured out. Hereupon, the contents-filled sealed bag is pulled in by the negative pressure with an exfoliation from an outer layer thereof, and consequently only an inner layer turns to be a bag and is then deformed by the contraction.

In a state where the gap holding rod is mounted in the suction port of the suction portion, the suction port is invariably held in an open state. Even if the contents-filled sealed bag is closely fitted to the gap holding rod, the contents-filled sealed bag is not, though closely fitted to the protruded portion of the gap holding rod, closely fitted to the recessed portion. Hence, this recessed portion is secured as a passageway for the contents. Accordingly, even when the contents are reduced, the contents can be surely sucked. The gap holding rod may also be, though internally fitted in the suction port and fixed thereto, mounted in the suction port through a mounting connection pipe.

Given herein is an explanation about a difference between operation characteristics depending on whether the protruded portion outermost side takes a circular arc or a straight line in terms of the sectional configuration of the gap holding rod.

As described above, the contents-filled sealed bag used in the present invention is composed of a soft material exhibiting a flexibility. Therefore, the operation for securing the passageways for the contents depends on not only the material of the sealed bag and the viscosity of the contents but also the sectional configuration of the gap holding rod. The followings are respective examinations which will be made.

(A) To start with, when adopting a more flexible material of the sealed bag (innermost layer), and if the opening of the recessed portion is too large, the close-fitting may easily happen even in the recessed portion, and the passageway is hard to secure.

(B) Next, if the contents are highly viscous, the operating portion is required to rise more quickly in order to lead the contents into the recessed portions and suck them up.

(C) Further, in terms of the sectional configuration, the passageways for the contents should be concentrated on the recessed portions as much as possible. For example, if a passageway is formed in a gap between the above protruded portion outermost side and the sealed bag (innermost layer), the passage is to disperse. As a result, a perimeter of the section of the passageway is long for a sum of the sectional areas of the passageway secured (a surface area of an internal wall of the passageway increases even at the same flow rate). A loss of friction increases correspondingly, resulting in a rise of a so-called pump loss.

One of the measures for obviating the above problems (B) and (C) may be to provide a much stronger spring (with a larger spring constant). Such a measure, however, needs a large operating force, enough to worsen a sense of use. Further, if the sectional area of the passageway is merely increased, it follows that the problem (A) may happen. Even under such conditions, it is desirable that the gap holding rod be formed in such a configuration as to expect that the contents are effectively transferred into the recessed portions due to the protruded portions and effectively led from the protruded portions due to the recessed portions.

In this respect, if the protruded portion outermost side at the front edge of the protruded portion takes a circular arc, it is predicted that a small passageway is hard to form between the protruded portion outermost side and the sealed bag (innermost layer). For this reason, the contents is hard to stay, and it can be expected as stated above that the contents are effectively transferred into the recessed portions due to the protruded portions and effectively led from the protruded portions due to the recessed portions.

Further, in the case of the soft sealed bag, each time it closely fits to the gap holding rod and separates therefrom, the soft sealed bag is repeatedly damaged by the edge of the protruded portion outermost side. It is therefor difficult to adopt the soft sealed bag. As in the case of the present invention, however, this can be prevented by using a protruded portion outermost side having an outwardly-convex protruded portion outermost side.

On the other hand, if the protruded portion outermost side is defined as a straight line in the sectional configuration, the gap holding rod can be formed by a molding method other than a contour extrusion molding method using a dedicated die. For instance, the gap holding rod is formed by joining precast tabular moldings with their sides each defined as a straight line in terms of the sectional configuration thereof. According to this method, the gap holding rod can be designed without being conditioned by manufacturing equipment.

The pump device according to the present invention is also established with an addition of constructive elements which will be given as follows.

First, there is employed the gap holding rod formed by the contour extrusion molding method. The gap holding rod can be formed by the contour extrusion molding method, cut off to a predetermined length and then used. This leads to a remarkably high productivity, and a reduction in costs can be attained.

Note that the contour extrusion molding method is a method of forming a special shape product by heat-pressurizing a thermoplastic material in an extruder and consecutively extruding it from the die, while the special shape product is an unshaped elongate extruded product that is not included in shaped products having sectional configurations such as a circle, a rectangle and a regular polygon.

Next, a swelling is formed at the front edge of each protruded portion of the gap holding rod. The gap holding rod is in an unstable state till it is extruded from the die by the contour extrusion molding method and hardened by cooling but enhanced in terms of its configurational retentivity thereof during that period by forming the above swelling.

Moreover, an outer peripheral surface of the suction portion is formed with grooves extending in such a direction as to get close to the suction port. The configuration of the groove is not particularly limited.

When the contents-filled sealed bag is closely fitted to the suction portion, and even if the contents stay in an upper area higher than the close-fitting portion thereof, the grooves formed in the outer peripheral surface of the suction porion are secured in the form of the passageways for the contents. Accordingly, the contents remaining in the upper area in the contents-filled sealed bag flow to the suction port. It is therefore possible to pour out substantially the whole quantity of contents to the very last content.

DETAILED DESCRIPTION OF PREFERRED EMBODIMENTS

Embodiments of the present invention will be discussed with reference to FIGS. 1 through 29.

[Embodiment 1]

Figure 2:
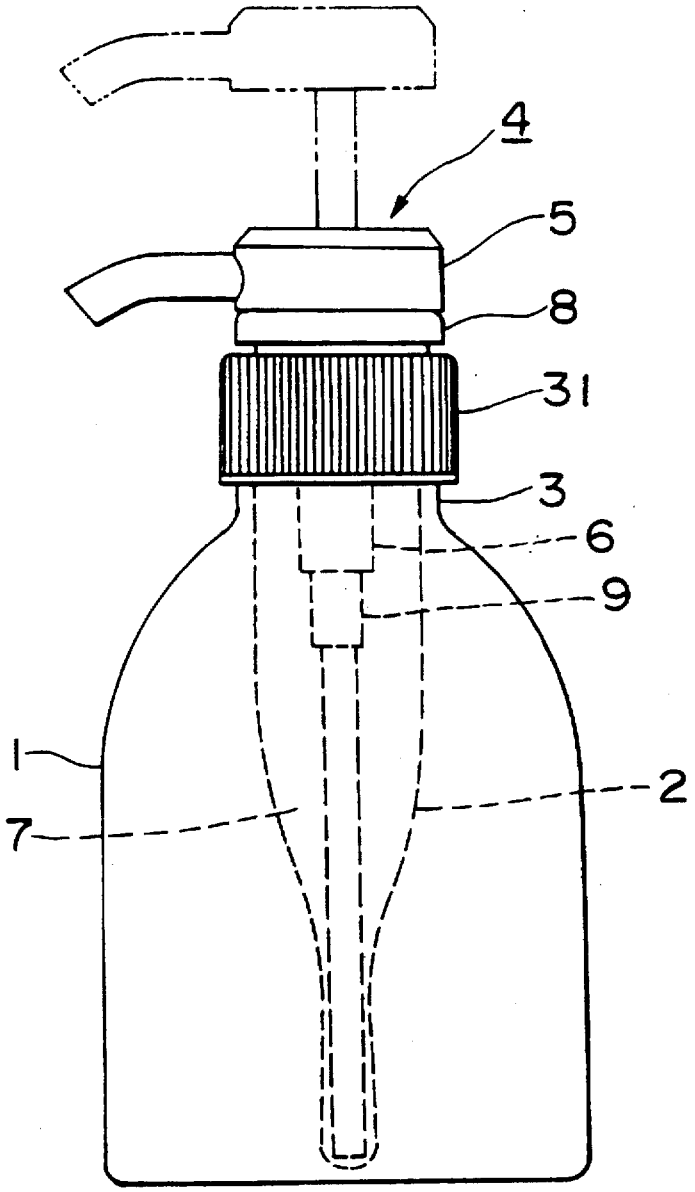
FIG. 2 is a an assembly outside view showing a state where the pump device in the first embodiment is mounted in a container.

As illustrated in FIG. 2, pump device 4 is fitted in a cylindrical mouth 3 of a container 1. A contents-filled sealed bag (hereinafter simply referred to as a sealed bag) exhibiting an elasticity is accommodated in an interior of the container 1, and this sealed bag 2 is filled with contents 7.

This pump device 4 includes an operating portion an upper edge of which is exposed to the outside of the container 1 and a suction portion 6 a large part of which except for the upper edge thereof is inserted into the above sealed bag 2.

The suction portion 6 is constructed of a connecting unit 8 exposed from the container 1 and a cylindrical unit 9 fixed to the connecting unit 8.

Figure 1:
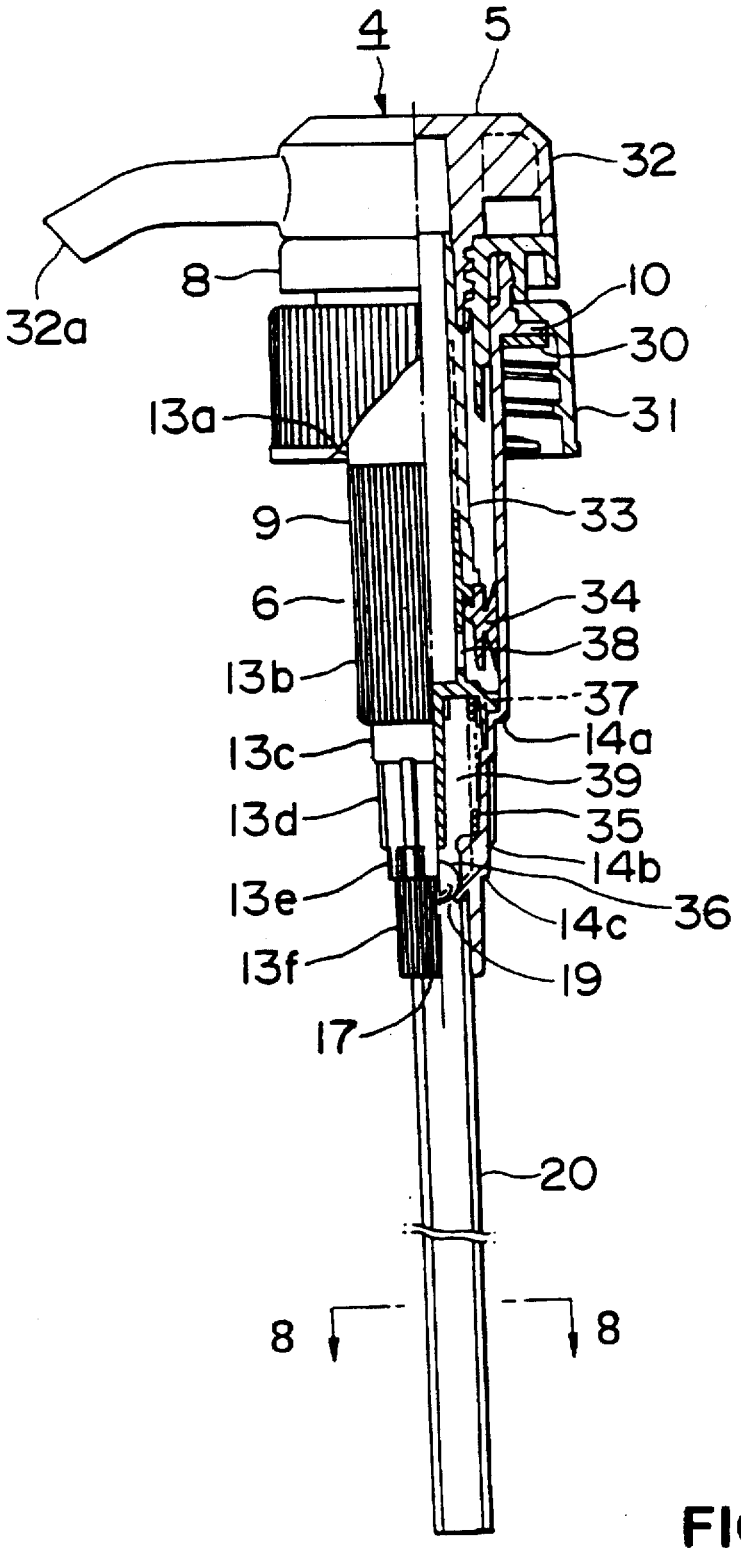
FIG. 1 is an assembly outside view illustrating a suction portion and a gap holding rod of a pump device in a first embodiment of the present invention.

As shown in FIG. 1, the suction portion 6 has a packing 30 interposed between a flange 10 and the cylindrical mouth 3 of the container 1, and a cap 31 is screwed onto the cylindrical mouth 3 from above of the flange 10, thus fixing the suction portion 6 to the container 1.

Figure 3:
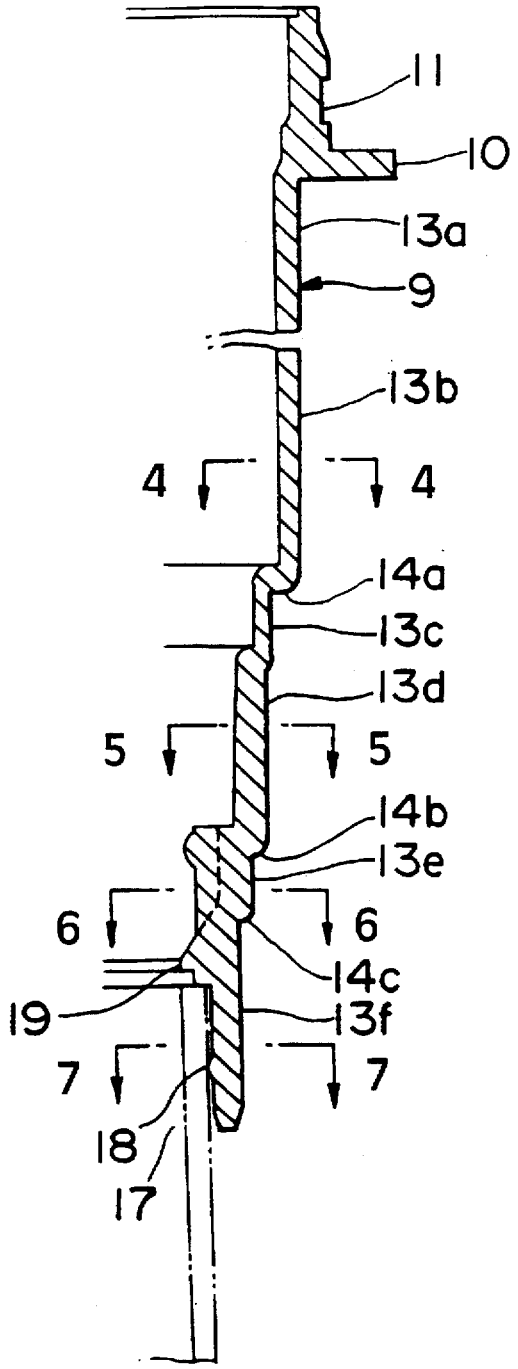
FIG. 3 is a principal enlarged vertical sectional view illustrating a suction portion of the pump device in the first embodiment.
Figure 4:
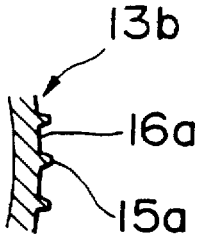
FIG. 4 is a sectional view taken substantially along the line 4—4 of FIG. 3.
Figure 5:
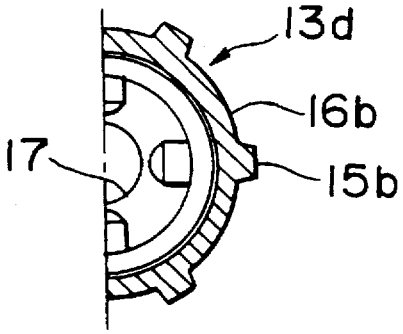
FIG. 5 is a sectional view taken substantially along the line 5—5 of FIG. 3.
Figure 6:
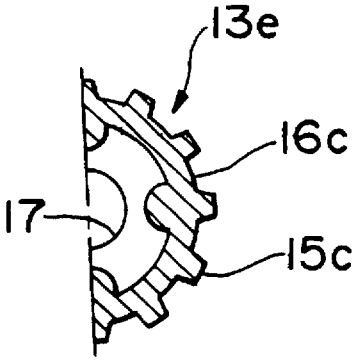
FIG. 6 is a sectional view taken substantially along the line 6—6 of FIG. 3.
Figure 7:
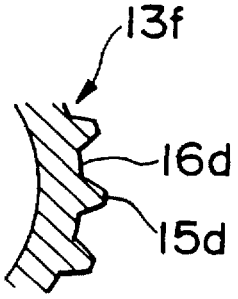
FIG. 7 is a sectional view taken substantially along the line 7—7 of FIG. 3.

A lower portion of the flange 10 is, as depicted in FIG. 3, formed with a first cylindrical portion 13*a*, a second cylindrical portion 13*b*, a third cylindrical portion 13*c*, a fourth cylindrical portion 13*d*, a fifth cylindrical portion 13*e* and a sixth cylindrical portion 13*f* as their diameters become smaller from above. Stepped portions 14*a*, 14*b*, 14*c* are formed at boundaries between the second and third cylindrical portion 13*b*, 13*c*, between the fourth and fifth cylindrical portions 13*d*, 13*e* and between the fifth and sixth cylindrical portions 13*e*, 13*f*.

FIGS. 4 through 7 are enlarged cross-sectional views illustrating the second cylindrical portion 13*b*, the fourth cylindrical portion 13*d*, the fifth cylindrical portion 13*e* and the sixth cylindrical portion 13*f*, respectively. First through fourth protruded portions 15*a*, 15*b*, 15*c*, 15*d* and first through fourth recessed portions (grooves) 16*a*, 16*b*, 16*c*, 16*d*, which extend along an axial line of a lower cylindrical unit 12, are alternately formed in circumferential directions on the outer peripheral surfaces of the second cylindrical portion 13*b*, the fourth cylindrical portion 13*d*, the fifth cylindrical portion 13*e* and the sixth cylindrical portion 13*f*, respectively.

The numbers and dimensions of those protruded portions 15–15*d* and the recessed portions 16*a*–16*d* are set so that the contents flow at a predetermined flow rate through liquid passageways formed between the sealed bag 2 and the individual recessed portions 16*a*–16*d*, even when the sealed bag 2 is brought into close contact with the cylindrical unit 9.

Further, as will be mentioned later, an internal surface of the first cylindrical portion 13*b* serves as a slide surface for a piston packing 34. However, the multiplicity of small protruded portions 15*a* and recessed portions 16*a* are formed on the outer peripheral surface of the first cylindrical portion 13*b*, and, therefore, a so-called sink mark is not formed in the internal surface of this first cylindrical portion when molded. Then, it follows that a slideability of the piston packing 34 in a liquid tight state is assured. Accordingly, this pump device 4 exhibits a high pump efficiency.

If a "sink mark" is formed in the internal surface of the first cylindrical portion 13*b*, a gap is produced between the internal surface of the first cylindrical portion 13*b* and the piston packing 34, with the result that a transfer of a negative pressure needed enough for the suction may fail to attain and the pump efficiency declines.

A suction portion 17 is opened at a lower edge of the sixth cylindrical portion 13*f*, and the contents 7 in the sealed bag 2 are sucked via this suction portion 17 by the pump device.

The operating portion 5 of the pump device 4 is constructed of a head member 32 formed with a discharge port 32*a* and a piston 33 linked to the head member 32 and moving up and down within the suction portion 6. The piston 33 assuming a bottomed cylindrical shape has a liquid passageway formed in the interior thereof and is connected to the discharge port 32*a* of the head member 32.

The piston packing 34 is slidably provided between the piston 33 and the internal surface of the second cylindrical portion 13*b*. The head member 32, the piston 33 and the piston packing 34 are elastically biased upward by a spring 35 provided in an area defined by the cylindrical unit 9.

FIG. 1 illustrates a state where the head member 32 is screwed to the connecting unit 8, and the piston 33 is thus made unmovable. When the head member 32 is screwed off the connecting unit 8, however, the head member 32, the piston 33 and the piston packing 34 are raised by a spring force of the spring 35, and the head member 32 is located as shown by two-dotted lines in FIG. 2.

A ball 36 for opening and closing the valve seat port 19 is housed in a lower area in the cylindrical unit 9. An outer edge portion of the bottom surface of the piston 33 is formed with a liquid passageway 37 in an area defined by the internal surface of the second cylindrical portion 13*b*, while a liquid passage hole 38 is formed in an area positioned more upstream than the liquid passageway 37 in the piston 33.

According to this pump device 4, when the head member 32, the piston 33 and the piston packing 34 are moved upward by the spring force of the spring 35, the piston packing 34 is raised while blockading the liquid passageway 37. As a result, the ball 36 is lifted by the negative pressure, and the valve seat port 19 is thereby lifted, with the result that the contents 7 flow via the suction port 17 to a temporary reserving chamber 39 positioned downwardly of the piston 33.

Thereafter, when the head member 32, the piston 33 and the piston packing 34 are lowered down resisting the spring force of the spring 35, the ball 36 blockades the valve seat port 19, and, at the same time, the piston packing 34 separates from the bottom surface of the piston 33 to open the liquid passageway 37. As a result, the content liquid runs via the liquid passageway 37 from the temporary reserving chamber 39 an d flows into t he piston 33 via the liquid passage hole 38. The content liquid is poured out of the discharge port 32*a* of the head member 32.

Further, a proximal end of a gap holding rod 20 is internally fitted in the sixth cylindrical portion 13*f* from the suction port 17 and fixed thereto. The gap holding rod 20 takes a rod-like shape and is formed in the same cross-sectional configuration throughout its entire length.

Moreover, a major diameter of the above circumscribed circle assuming the sectional configuration given above is set slightly smaller than a minor diameter of the suction portion 17 but a little bit larger than a minor diameter of a removal preventive protrusion 18 provided on an inner peripheral surface of the sixth cylindrical portion 13*f*. This arrangement is such that it is internally tightly fitted in the removal preventive protrusion 18 and fixed thereto when the proximal end of the gap holding rod 20 is inserted into the suction port 17.

A front edge o f this gap holding rod 20 extends toward the bottom of the container 1, i.e., the bottom of the sealed bag 2.

Note that a high productivity and a reduction in costs can be attained by using the gap holding rod 20 formed by a contour extrusion and cut off to a predetermined length.

According to this pump device 4, even if the sealed bag 2 is closely fitted to the gap holding rod 20 as the contents 7 are reduced, the sealed bag 2 is closely fitted to each protruded portion 21 of the gap holding rod 20 but can not be closely fitted to each recessed portion 22, and, hence, this recessed portion 22 is secured as a passageway for the contents 7. Further, the suction port 17 is also held in an opened state by the gap holding rod 20.

Accordingly, even when the contents 7 are reduced, the contents 7 can be surely sucked, and a rising return motion of the operating portion 5 can be also certainly performed.

In addition, even if the sealed bag 7 is closely fitted to the suction portion 6 with the result that the contents 7 stay more upward that the closely-fitted area, the outer peripheral surface of the suction portion 6 is formed with the protruded portions 15*a*–15*d* and the recessed portions 16*a*–16*d*, and therefore the recessed portions 16*a*–16*d* are secured as the passageways. Consequently, the contents 7 remaining upward of the sealed bag 2 come to flow into the suction port 17.

Figure 8:
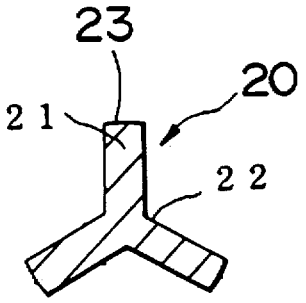
FIG. 8 is a cross-sectional view of the gap holding rod in the first embodiment as well as being a sectional view taken substantially along the line 8—8 of FIG. 1.
Figure 9:
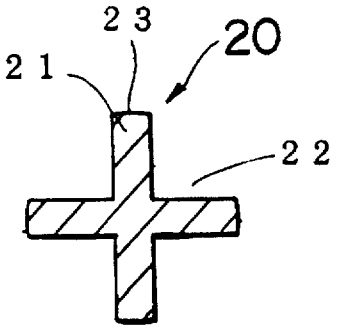
FIG. 9 is a cross-sectional view illustrating a gap holding rod in another embodiment of the present invention.
Figure 10:
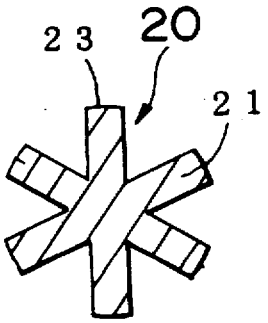
FIG. 10 is a cross-sectional view illustrating a gap holding rod in still another embodiment of the present invention.

FIGS. 8, 9 and 10 are enlarged cross-sectional views each showing the gap holding rod 20.

The gap holding rod 20 in this embodiment is constructed by alternately forming the protruded portions and the recessed portions in the circumferential direction, these convex and recessed portions extending in the longitudinal direction over the entire length thereof. FIG. 8 shows an example of the gap holding rod, wherein the convex and recessed portions are provided by threes. FIG. 9 illustrates an example thereof, wherein the convex and recessed portions are provided by fours. FIG. 10 shows an example thereof, wherein the convex and recessed portions are provided by sixes.

Further, the above recessed portions of the gap holding rod have no inward area having a width larger than the opening portion, and, on the occasion of molding, it is therefore possible to adopt a method of cutting inward a precast integral molding, such as an angular rod or the like from its outer peripheral portion.

As discussed above, according to this pump device 4, the contents 7 can be poured out of the sealed bag 2 until a substantially entire quantity of the contents 7 completely disappear.

Further, this pump device is also usable for a laminated container. The term "laminated container" implies a laminated blow plastic container having at least a double-layered structure, wherein an innermost layer thereof can be exfoliated from an outer layer thereof, and a configuration of its external appearance is prevented from being changed.

In the laminated container, when the interior of the container is depressurized as the contents are poured out, the innermost layer is pulled by a negative pressure enough to be peeled off the outer layer thereof, and only the innermost layer turns out to be a bag and is deformed by contraction. In this laminated container, the innermost layer corresponds to the sealed bag in the embodiment discussed above.

When this pump device is used for the laminated container, even if the sealed bag 2 comes in close contact with the gap holding rod 20, the gap holding rod 20 acts in the same manner as that in the embodiment given above and secures the passageway for the contents 7, whereby the whole quantity of the contents 7 can be substantially completely poured out.

[Embodiment 2]

Given hereinafter is an explanation of an example of adopting a gap holding rod taking a different sectional configuration.

Figure 11:
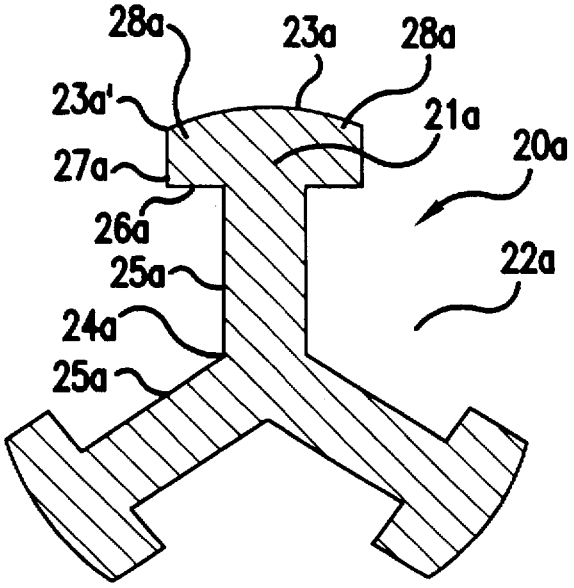
FIG. 11 is a cross-sectional view illustrating a gap holding rod in yet another embodiment of the present invention.

FIG. 11 is an enlarged cross-sectional view of the gap holding rod in an embodiment 2.

Examining each of sides of the sectional shape of a gap holding rod 20*a* in this embodiment, outermost sides (hereafter termed protruded portion outermost sides) exist at front edges of protruded portions 21*a* but each assume an outwardly-convex circular arc. Then, all the sides exclusive of the protruded portion outermost sides in section, i.e., remaining sides of the protruded portions (protruded portion lateral sides) and sides of recessed portions (hereafter termed inward sides) are defined as straight lines.

More specifically, the protruded portion 21*a* has first protruded portion lateral sides 25*a* extending outward from proximal points 24*a* substantially in parallel to a protruded portion central line passing through substantially the center of the section of the gap holding rod 20*a* and also the center of the protruded portion 21*a*. The protruded portion 21*a* also has second protruded portion lateral sides 26*a* extending outward from outer edges of the first protruded portion lateral sides 25*a* substantially perpendicularly to the protruded portion central line in directions opposite to each other. The protruded portion 21*a* further has third protruded portion lateral sides 27*a* extending substantially perpendicularly from outer edges of the second protruded portion lateral sides 26*a* substantially in parallel to the first protruded portion lateral sides 25*a*. Moreover, each of the protruded portions 21*a* bears such a state that the first protruded portion lateral side 25 is contiguous at the proximal point 24*a* to the other first protruded portion lateral side 25*a* adjacent thereto.

As illustrated in FIG. 11, the protruded portion of the gap holding rod 20*a* in this embodiment is formed with a swelling 28*a* extending substantially perpendicularly to the protruded portion central line toward the recessed portion. This swelling is advantageous in terms of a retentivity of the configuration thereof when the gap holding rod 20*a* is formed by the contour extrusion.

[Embodiment 3]

Figure 12:
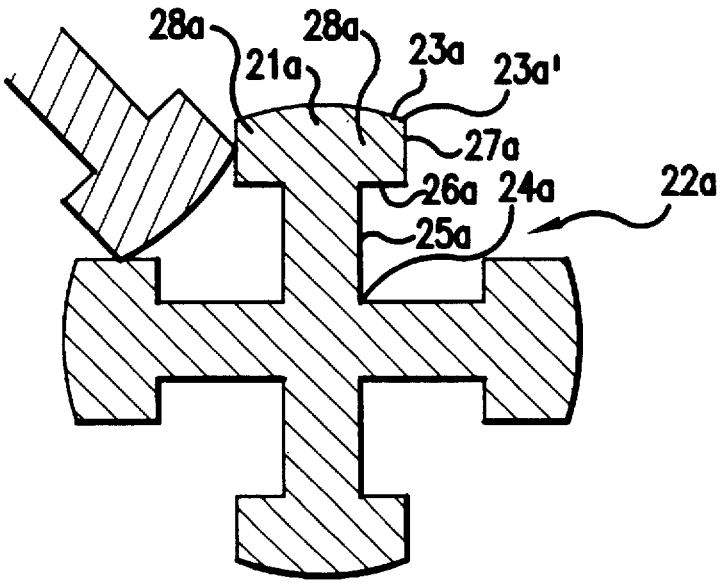
FIG. 12 is a cross-sectional view illustrating a gap holding rod in a further embodiment of the present invention.

FIG. 12 illustrates an example where four lengths of the gap holding rods shown in the example of FIG. 11 are provided. The operation and effect thereof can be applied to a softer sealed bag 2 (innermost layer) because of a smaller opening of the recessed portion.

Furthermore, as in this example, if there are protruded portions having a considerable number of swellings 28, and when a width of the protruded portion is larger than the opening of the recessed portion, the gap holding rods are superposed, bundled and thus closely fitted to each other as seen when molded or housed, and, in such a case, there is no possibility in which the protruded portion of another gap holding rod is intruded into the recessed portion. It is therefore possible to avoid causing troubles to those operations.

[Embodiment 4]

As stated above, the gap holding rod 20 is based on such a construction that the protruded portions and the recessed portions are alternately formed in the circumferential direction in terms of its sectional configuration but exhibits a different operation and effect depending on a difference in the sectional configuration thereof.

Explained further are gap holding rod examples considered otherwise while classifying those rods on the basis of whether or not particularly the protruded portion outermost side 23 takes the circular arc in terms of the sectional shape thereof.

The second and third embodiments discussed above have presented the gap holding rod having the outwardly-convex outermost side of the protruded portion and other sides defined as the straight lines in terms of the sectional configuration thereof. There will be, however, explained other examples of a similar gap holding rod in accordance with the fourth through tenth embodiments which follow.

Figure 13:
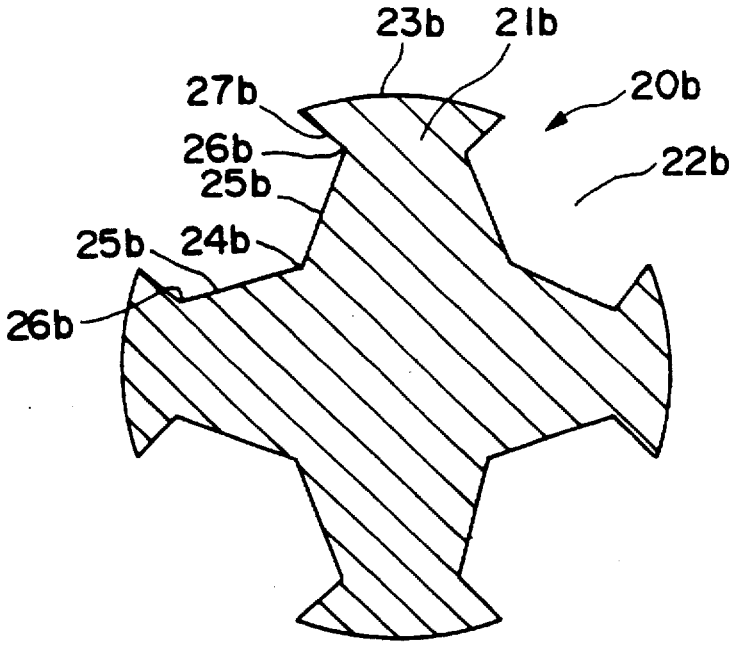
FIG. 13 is a cross-sectional view illustrating a gap holding rod in a still further embodiment of the present invention.

FIG. 13 is an enlarged cross-sectional view illustrating the gap holding rod in this embodiment.

Examining also each of the sides in section, a gap holding rod **20*b*** in terms of the sectional shape thereof, takes the following constructions:

(1) A protruded portion **21*b* includes first protruded portion lateral sides 25*b* extending outward from proximal points 24*b* to protruded portion necks 26*b* in a tapered shape with respect to the protruded portion central line passing through the center of the protruded portion as well as through substantially the center of the section of the gap holding rod 20*b*. The protruded portion 21*b* also includes second protruded portion lateral sides 27*b* extending in an invert-tapered shape from the protruded portion necks 26*b* to edges 23*b*' of the protruded portion outermost sides 23*b***, each of which is in the shape of a circular arc.

(2) In each of the protruded portions **21*b*, the first protruded portion lateral side 25*b* is contiguous at the proximal point to the other first protruded portion lateral side 25*b*** adjacent thereto.

As illustrated in FIG. 13, the gap holding rod **20*b* has, in terms of the sectional configuration thereof, a greater number of protruded portions than in the gap holding rod (embodiment 3) of FIG. 11, and, as a result of this, a recessed portion 22*b* has a narrower opening. Then, even in the case of a softer sealed bag 2 (innermost layer), another protruded portion is prevented from being intruded into the recessed portion 22*b*** and closely fitted thereto.

Further, the protruded portion **21*b*** takes the tapered shape, i.e., it has a large-width proximal portion, and, therefore, there is obtained a good configurational retentivity (hereafter termed a molding configurational retentivity) when molding the gap holding rod by a contour extrusion molding method.

[Embodiment 5]

Figure 14:
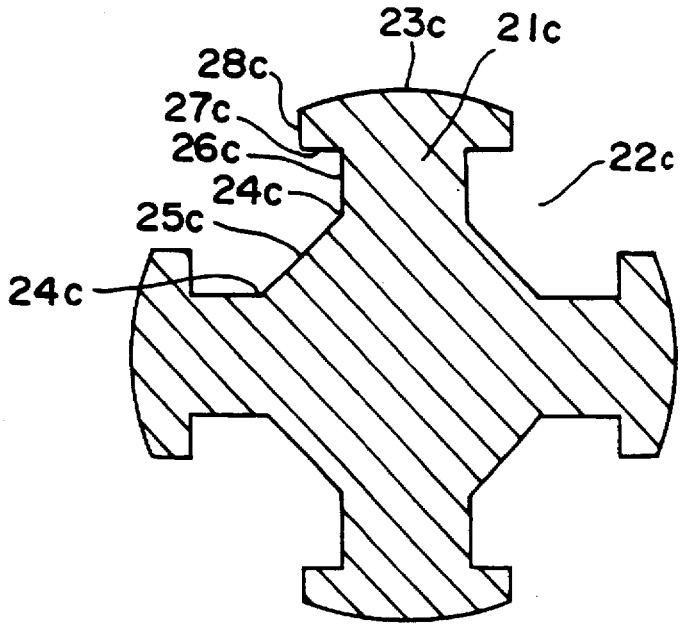
FIG. 14 is a cross-sectional view illustrating a gap holding rod in a yet further embodiment of the present invention.

FIG. 14 is an enlarged cross-sectional view illustrating a gap holding rod in a first embodiment.

A gap holding rod **20*c*** takes, in terms of the sectional configuration thereof, the following constructions:

(1) A recessed portion base **25*c* is formed between respective proximal points 24*c* of adjacent protruded portions 21*c* in a face-to-face relationship substantially perpendicular to a radius of a circle concentric with the center of the section of the gap holding rod 20*c***.

(2) The protruded portion **21*c* includes first protruded portion lateral sides 26*c* extending outward from the proximal points 24*c* substantially in parallel to the protruded portion central line passing through the center of the protruded portion 21*c* as well as through the center of the above circle. The protruded portion 21*c* also includes second protruded portion lateral sides 27*c* extending from outer edges of the first protruded portion lateral sides 26*c* substantially perpendicularly to the protruded portion central line in directions opposite to each other. The protruded portion 21*c* further includes third protruded portion lateral sides 28*c* extending outward substantially perpendicularly from the second protruded portion lateral sides 27*c* substantially in parallel to the first protruded portion lateral sides 26*c***.

The gap holding rod in accordance with this embodiment has, in terms of the sectional configuration thereof, the same numbers of the protruded portions and of the recessed portions as those in the example of FIG. 13 (embodiment 4). In addition, however, a gap holding rod **20*c* has, in terms of its sectional shape, the narrower opening of the recessed portion and is suitable for a softer sealed bag 2 (innermost layer) than in the example of FIG. 13**.

Further, as depicted in FIG. 14, the protruded portion **21*c* contributes to a rigidity of the molding because of the short sides formed outwardly of the proximal points 24*c* of the protruded portion 21*c*** and exhibits good molding configurational retentivity.

[Embodiment 6]

Figure 15:
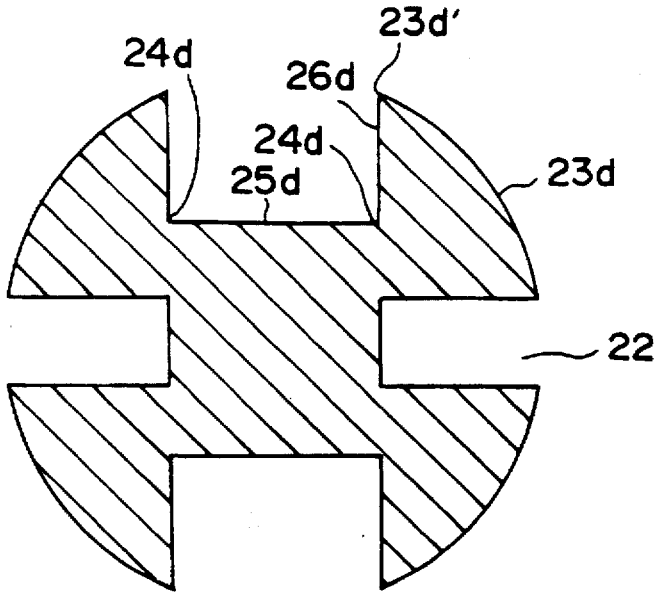
FIG. 15 is a cross-sectional view illustrating a gap holding rod in an additional embodiment of the present invention.

FIG. 15 is an enlarged cross-sectional view of a gap holding rod in a sixth embodiment.

A gap holding rod **20*d*** takes, in terms of the sectional configuration thereof, the following constructions:

(1) A recessed portion base **25*d* is formed between respective proximal points 24*d* of adjacent protruded portions 21*d* in the face-to-face relationship, substantially perpendicular to the radius of a circle concentric with a center of the section of the gap holding rod 20*d***.

(2) The protruded portion **21*d* includes protruded portion lateral sides 26*d* extending outward from the proximal points 24*d* substantially perpendicularly to recessed portion base 25*d* to edges 23*d*' of protruded portion outermost sides 23*d***, each of which is in the shape of a circular arc.

The gap holding rod **20*d*** in this embodiment is to give the above expectation that the contents are effectively transferred into the recessed portions with the aid of the protruded portions and effectively led from the protruded portions with the aid of the recessed portions when outermost side takes the outwardly-convex circular arc. In addition to this, since the above recessed portion has no inward area having a width larger than the opening, a method of cutting a precast cylindrical molding from its outer peripheral portion toward the center thereof is used.

It is to be noted that lengths of the recessed portion bases **25*d*** adjacent to each other are different from each other (the recessed portions adjacent to each other have different shapes), but those bases may have substantially the same length (the recessed portions have substantially the same configuration).

[Embodiment 7]

Figure 16:
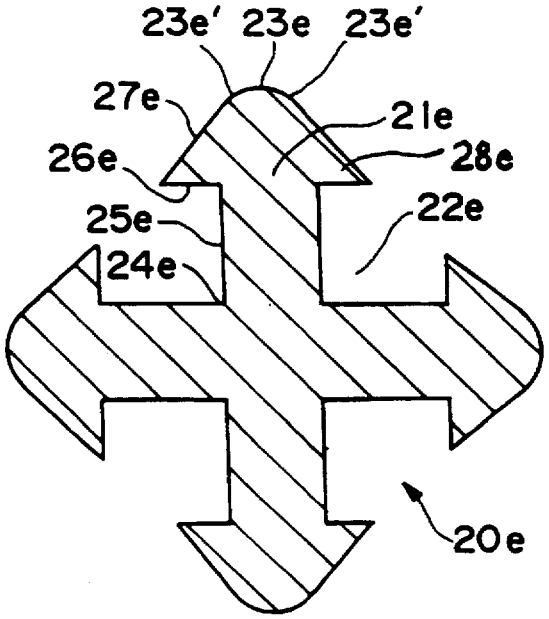
FIG. 16 is a cross-sectional view illustrating a gap holding rod in a further additional embodiment of the present invention.

FIG. 16 is an enlarged cross-sectional view of a gap holding rod in a seventh embodiment.

A gap holding rod **20*e*** takes, in terms of the sectional configuration thereof, the following constructions:

(1) A protruded portion **21*e* has first protruded portion lateral sides 25*e* extending outward from proximal points 24*e* substantially in parallel to the protruded portion central line passing through substantially the center of the section of the gap holding rod 20*e* and the center of the protruded portion 21e. The protruded portion 21e also has second protruded portion lateral sides 26e extending from outer edges of the first protruded portion lateral sides 25e substantially perpendicularly to the protruded portion central line in directions opposite to each other. The protruded portion 21e further has third protruded portion lateral sides 27e formed outwardly of the second protruded portion lateral sides 26e and contiguous, without being bent, to edges 23' of protruded portion outermost sides 23e, each of which is in the shape of a circular arc forming an acute angle in combination with the second protruded portion lateral sides 26e**.

(2) In each of the protruded portions 21e, the first protruded portion lateral side 25e is contiguous at the proximal point 24e to the first protruded portion lateral side 25e, adjacent thereto, of the other protruded portion.

The gap holding rod 20e in accordance with this embodiment takes, in terms of the sectional configuration thereof, as illustrated in FIG. 16, a larger areal size of the recessed portion than the opening of the recessed portion, whereby the soft sealed bag 2 (innermost layer) is prevented from intruding into the recessed portion 22e and closely fitting thereto.

Further, as shown in FIG. 16, a multiplicity of short inner lateral sides are provided. Therefore, the above molding configurational retentivity is also enhanced.

Moreover, as in the third embodiment, the protruded portion has swellings 28e that are each larger than the opening of the recessed portion, and hence there is no possibility in which the protruded portion of another gap holding rod is intruded into the recessed portion.

[Embodiment 8]

Figure 17:
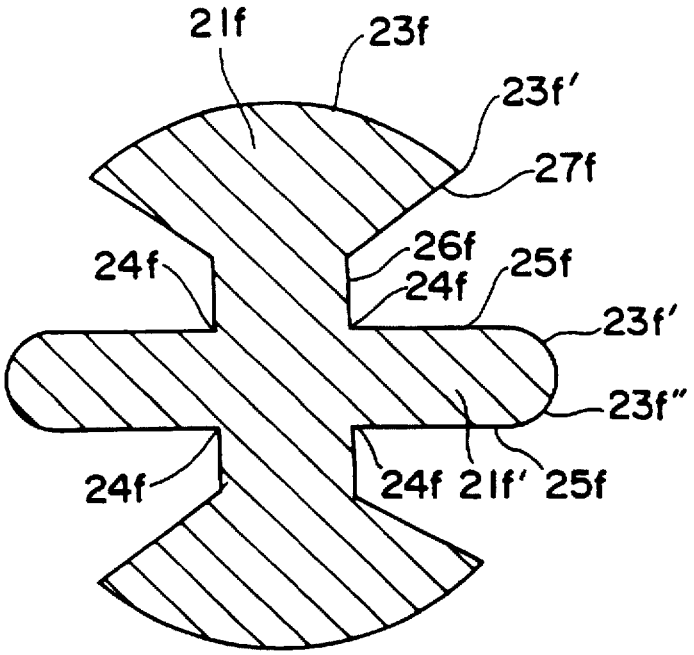
FIG. 17 is a cross-sectional view illustrating a gap holding rod in a yet additional embodiment of the present invention.

FIG. 17 is an enlarged cross-sectional view of a gap holding rod in an eighth embodiment.

A gap holding rod 20f takes, in terms of the sectional configuration thereof, the following constructions:

(1) One first protruded portions 21f' of the protruded portions 21f adjacent to each other has first protruded portion lateral sides 25f extending outward from proximal points 24f substantially in parallel to a protruded portion central line passing through substantially the center of the section of the gap holding rod 20f and the center of the first protruded portion 21f, the first protruded portion lateral sides 25f being contiguous, without being bent, to edges 23f of protruded portion outermost sides 23f, each of which is in the shape of a circular arc.

(2) Other second protruded portions 21f" of the protruded portions 21f adjacent to each other have second protruded portion lateral sides 26f extending outward from the proximal points 24f substantially in parallel to the protruded central line passing through substantially the center of the section of the gap holding rod 20f and the center of the second protruded portion 21f" and third protruded lateral sides 27f extending from outer edges of the second protruded portion lateral sides 26f to edges 23f" of protruded portion outermost sides 23f inwardly of extension lines of the second protruded portion lateral sides 26f.

(3) The first protruded portion lateral side 25f is contiguous at the proximal point 24f to the second protruded portion lateral side 26f adjacent thereto.

The gap holding rod 20f in this embodiment has, in terms of the sectional configuration thereof, such a construction that the larger protruded portion outermost sides and the smaller protruded portion outermost sides are, as illustrated in FIG. 17, alternately disposed. In combination with the arrangement wherein the large recessed portions are formed but supplemented with the small protruded portions, the gap holding rod 20f gives such an expectation that the contents are effectively eliminated owing to the protruded portions and effectively led owing to the recessed portions, which is inherent in the protruded portion outermost sides having the outwardly-convex circular arc.

Further, the recessed portion is formed to have its interior invariably larger than the opening, and, hence, as in the example of FIG. 15, the recessed portion has no inward area with a width larger than the opening. Therefore, on the occasion of molding, the method of cutting the precast cylindrical molding from its outer peripheral portion toward the center thereof can be used.

[Embodiment 9]

Figure 18:
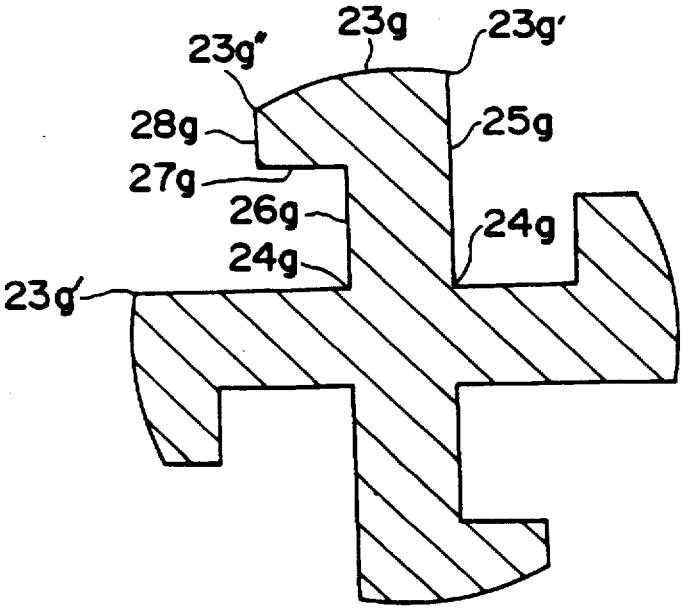
FIG. 18 is a cross-sectional view illustrating a gap holding rod in another embodiment of the present invention.

FIG. 18 is an enlarged cross-sectional view of a gap holding rod in a ninth embodiment.

A gap holding rod 20g takes, in terms of the sectional configuration thereof, the following constructions:

(1) Each protruded portion 21g includes a first protruded portion lateral side 25g extending outward from a proximal point 24g on one side to one edge 23g' of a protruded portion outermost side 23g assuming a circular arc substantially in parallel to the protruded portion central line passing through substantially the center of the section of the gap holding rod 20g and the center of the protruded portion 21g.

(2) The protruded portion 21g includes a second protruded portion lateral side 26g extending outward from the proximal point 24g on the other side substantially in parallel to the first protruded portion lateral side 25g. The protruded portion 21g also includes third protruded portion lateral sides 27g extending from outer edges of the second protruded portion lateral sides 26g substantially perpendicularly to the protruded portion central line in directions opposite to each other. The protruded portion 21g further includes a fourth protruded portion lateral side 28g extending to other edge 23g" of the protruded portion outermost side 23g substantially perpendicularly from an outer edge of the third protruded portion lateral side 27g substantially in parallel to the second protruded portion lateral side 26g.

(3) In each protruded portion 21g, the first protruded portion lateral side 25g is contiguous at the proximal point 24g to the second protruded portion lateral side 26g, adjacent thereto, of other protruded portion.

The gap holding rod 20g in this embodiment gives such an expectation that the contents are effectively eliminated owing to the protruded portions and effectively led owing to the recessed portions, which is inherent in the protruded portion outermost side assuming the outwardly-convex circular arc. Is addition to this, the embodiment good molding configurational retentivity because of each protruded portion being, as illustrated in FIG. 18, crooked in terms of the sectional shape thereof.

Furthermore, as depicted in FIG. 18, the recessed portion has no inward area with a width larger than the opening. Therefore, on the occasion of molding, the method of cutting the precast cylindrical molding from its outer peripheral portion toward the center thereof can be used.

[Embodiment 10]

Figure 19:
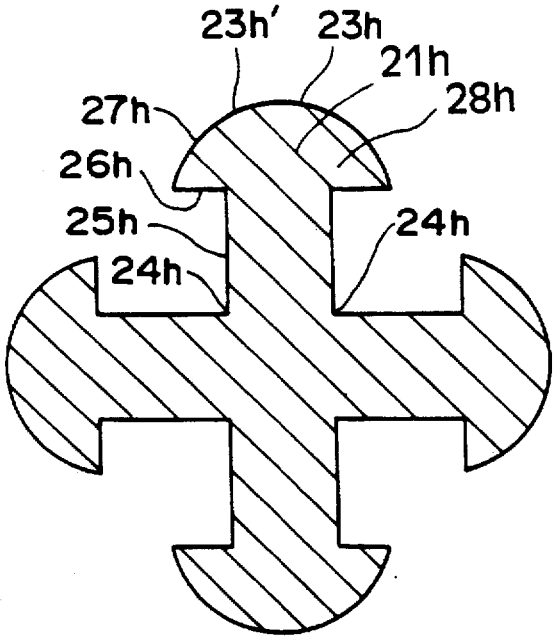
FIG. 19 is a cross-sectional view illustrating a gap holding rod in another embodiment of the present invention.

FIG. 19 is an enlarged cross-sectional view of a gap holding rod in a tenth embodiment.

A gap holding rod 20h takes, in terms of the sectional configuration thereof, the following constructions:

(1) A protruded portion 21h has first protruded portion lateral sides 25h extending outward from proximal points 24h substantially in parallel to the protruded portion central line passing through substantially the center of the section of the gap holding rod 20h and the center of the protruded portion 21h. The protruded portion 21h also has second protruded portion lateral sides 26h extending from outer edges of the first protruded portion lateral sides 25h substantially perpendicularly to the protruded portion central line in directions opposite to each other. The protruded portion 21h further has third protruded portion lateral sides 27h assuming a circular arc having its center at a point in the vicinity of the front edge of the protruded portion 21h and contiguous, without being bent, to edges 23h' of protruded portion outermost sides 23h, each of which is in the shape of a circular arc outwardly of the respective second protruded portion lateral sides 26h.

(2) In each protruded portion 21h, the first protruded portion lateral side 25h is contiguous at the proximal point 24h to the first protruded portion lateral side 25h, adjacent thereto, of other protruded portion.

The gap holding rod 20h in this embodiment gives such an expectation that the contents are effectively eliminated owing to the protruded portions and effectively led owing to the recessed portions, which is inherent in the protruded portion outermost side assuming the outwardly-convex circular arc and. In addition to this, this embodiment exhibits good molding configurational retentivity because of a portion between the first protruded portion lateral side 25h and the second protruded portion lateral side 26h being, as illustrated in FIG. 19, crooked in terms of the sectional shape thereof.

Furthermore, as depicted in FIG. 19, the interior of the recessed portion is larger than the opening, with the result that the soft sealed bag 2 (innermost layer) is prevented from intruding into the recessed portion. There is formed no angular projection directed outward, and particularly even the soft sealed bag 2 (innermost layer) is hard to damage.

Further, similarly the protruded portion has a swelling 28h larger than the opening of the recessed portion, and there is also no possibility in which the protruded portion of another gap holding rod intrudes into the recessed portion.

[Embodiment 11]

Given next is an explanation of an example of a gap holding rod wherein, in terms of the sectional configuration thereof, a protruded portion outermost side thereof assumes an outwardly-convex circular arc, and all other sides exclusive of the above-mentioned side each take a circular arc.

Figure 20:
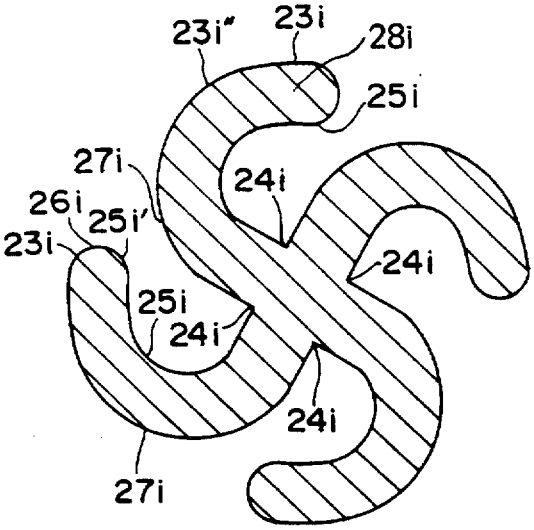
FIG. 20 is a cross-sectional view illustrating a gap holding rod in another embodiment of the present invention.

FIG. 20 is an enlarged cross-sectional view of a gap holding rod 20i in an eleventh embodiment.

The gap holding rod 20i takes, in terms of the sectional configuration thereof, the following constructions:

(1) Each protruded portion 21i includes a first protruded portion lateral side 25i extending outward from a proximal point 24i on one side and taking a circular arc having its center at a point in the vicinity of the center of a radius of a circumscribed circle of the section of the gap holding rod 20i and also its diameter smaller than the above radius. The protruded portion 21i also includes a second protruded portion lateral side 26i extending from an outer edge 25i' of the first protruded portion lateral side 25i to one edge 23i' of a protruded portion outermost side 23i and taking an outwardly-convex semicircle having its diameter substantially equal to a distance between the above two edges.

(2) The protruded portion 21i has a third protruded portion lateral side 27i extending outward from the proximal point 24i on the other side and taking a circular arc having its center at a given point slightly more inward than the vicinity of the center of the above circumscribed circle and also its diameter slightly longer than the radius of the above circumscribed circle, the third protruded portion lateral side 27i being contiguous, without being bent, to the edge 23i' of the protruded portion outermost side 23i.

(3) In each protruded portion 21i, the first protruded portion lateral side 25i is contiguous at the proximal point 24i to the third protruded portion lateral side 27i, adjacent thereto, of other protruded portion.

The gap holding rod 20i in this embodiment exhibits, though the inner lateral side has a different configuration thereof, the same operation and effect as those in the example of FIG. 19.

That is, the gap holding rod gives such an expectation that the contents are effectively eliminated owing to the protruded portions and effectively led owing to the recessed portions, which is inherent in the protruded portion outermost side assuming an outwardly-convex circular arc, and, as illustrated in FIG. 20, the interior of the recessed portion is larger than the opening, with the result that the soft sealed bag 2 (innermost layer) is prevented from intruding into the recessed portion. Then, there is formed no angular projection directed outward, and particularly even the soft sealed bag 2 (innermost layer) is hard to damage.

Then, similarly the protruded portion has a swelling 28i larger than the opening of the recessed portion, and there is also no possibility in which the protruded portion of another gap holding rod intrudes into the recessed portion.

[Embodiment 12]

Given next is an explanation of an example of a gap holding rod wherein, in terms of the sectional configuration thereof, a protruded portion outermost side thereof assumes an outwardly-convex circular arc, and all other sides exclusive of the above-mentioned side take circular arcs or straight lines.

Figure 21:
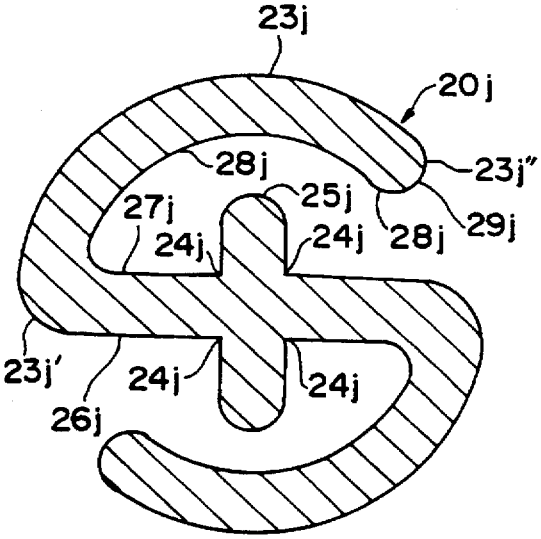
FIG. 21 is a cross-sectional view illustrating a gap holding rod in another embodiment of the present invention.

FIG. 21 is an enlarged cross-sectional view of a gap holding rod 21j in a twelfth embodiment.

The gap holding rod 20j takes, in terms of the sectional configuration thereof, the following constructions:

(1) Intra recessed portion campanulate protrusions 25k are formed between respective proximal points 24j of adjacent protruded portions 21j in a face-to-face relationship.

(2) The protruded portion 21j includes a first protruded portion lateral side 26j extending outward from the proximal point 24j on one side to one edge 23j' of a protruded portion outermost side 23j taking a circular arc substantially in parallel to the protruded portion central line passing through substantially the center of the section of the gap holding rod 20j and the center of the protruded portion 21j.

(3) The protruded portion 21j also includes a second protruded portion lateral side 27j extending outward from the proximal point on the other side substantially in parallel to the first protruded portion lateral side 26j. The protruded portion 21j further includes a third protruded portion lateral side 28j extending inwardly of a protruded portion outermost side 23j from the outer edge of the second protruded portion lateral side 27j at an equal interval with respect to the protruded portion outermost side 23j. The protruded portion 21j still further includes a fourth protruded portion lateral side 29j defined as an outwardly-convex semicircle between an outer edge 28j' of the third protruded portion lateral side 28j and other edge 23j" of the protruded portion outermost side 23j, the above semicircle having a diameter substantially equal to a distance between those two edges.

The gap holding rod 20j in accordance with this embodiment also exhibits the same operations and effects as those in the examples of FIGS. 19 and 20.

That is, the gap holding rod 20j gives such an expectation that the contents are effectively eliminated owing to the protruded portions and effectively led owing to the recessed portions, which is inherent in the protruded portion outermost side assuming the outwardly-convex circular arc, and, as illustrated in FIG. 21, the interior of the recessed portion is larger than the opening, with the result that the soft sealed bag 2 (innermost layer) is prevented from intruding into the recessed portion and fitting thereto. Then, there is formed no angular projection directed outward, and particularly even the soft sealed bag 2 (innermost layer) is hard to damage.

Further, in accordance with this embodiment, the intra recessed portion campanulate protruded portion 25j contributes to the above molding configurational retentivity of the gap holding rod 20j.

[Embodiment 13]

Figure 22:
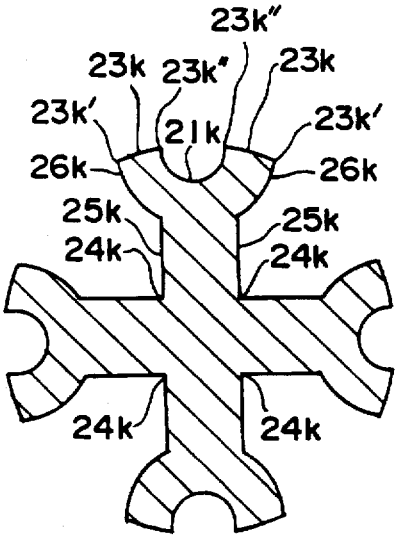
FIG. 22 is a cross-sectional view illustrating a gap holding rod in another embodiment of the present invention.

FIG. 22 is an enlarged cross-sectional view of a gap holding rod 20k in a thirteen embodiment.

The gap holding rod 20k takes, in terms of the sectional configuration thereof, the following constructions:

(1) A protruded portion 21k has an intra protruded portion substantially-semicircular recessed portion 21k' segmenting a protruded portion outermost side 23k into two pieces of circular arcs 23'–23k" and 23k"–23k' and having a diameter substantially equal to a distance between two inner edges 23k" of the two circular arcs.

(2) The protruded portion 21k includes a first protruded portion lateral side 25k extending outward from a proximal point 24k substantially in parallel to the protruded portion central line passing through substantially the center of the section of the gap holding rod 20k and the center of the protruded portion 21k. The protruded portion 21k also has a second protruded portion lateral side 26k concentric with the circle partly composed of the intra protruded portion semicircular recessed portion 21k', assuming a circular arc of a circle having a much larger radius and extending from an outer edge of the first protruded portion lateral side 25k to an outer edge 23k' of the protruded portion outermost side 23k.

(3) In each protruded portion 21k, the first protruded portion lateral side 25k is contiguous at the proximal point 24k to the first protruded portion lateral side 25k, adjacent thereto, of another protruded portion.

The gap holding rod 20k in this embodiment includes the multiplicity of recessed portions as shown in FIG. 22 and therefore certainly gives such an expectation that the contents are effectively eliminated owing to the protruded portions and effectively led owing to the recessed portions, which is a basic characteristic when the protruded portion outermost side takes the outwardly-convex circular arc. In addition, as depicted in FIG. 22, the multiplicity of inner lateral sides are provided, and, hence, the above molding configurational retentivity is also enhanced.

[Embodiment 14]

Figure 23:
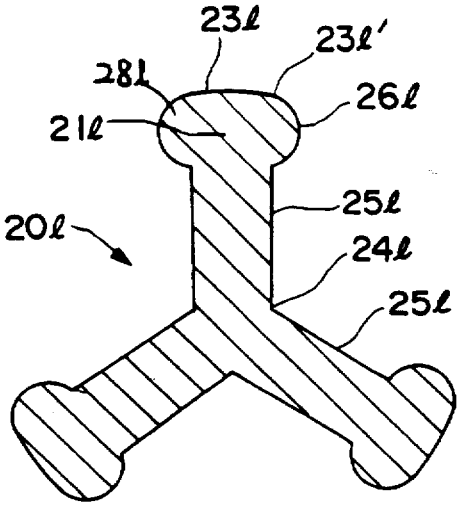
FIG. 23 is a cross-sectional view illustrating a gap holding rod in another embodiment of the present invention.

FIG. 23 is an enlarged cross-sectional view of a gap holding rod 201 in an embodiment 14.

The gap holding rod 20l takes, in terms of the sectional configuration thereof, the following constructions:

(1) A protruded portion 21l includes a first protruded portion lateral side 25l extending outward from a proximal point 24l substantially in parallel to the protruded portion central line passing through substantially the center of the gap holding rod 20l and the center of the protruded portion 21l. The protruded portion 21l also includes a second protruded portion lateral side 26l extending from an outer edge 25l' of the first protruded portion lateral side 25l and defined as a semicircle having its center at a point in the vicinity of the front edge of the protruded portion 21l and also its diameter substantially equal to a width of the first protruded portion lateral side 25l of the protruded portion 21l, the second protruded lateral side 26l being, without being bent, contiguous to an edge 23l' of a protruded portion outermost side 23l.

(2) In each protruded portion 21l, the first protruded portion lateral side 25l is contiguous at the proximal point 24l to the second protruded portion lateral side 25l, adjacent thereto, of another protruded portion.

The gap holding rod 20l in this embodiment gives surely such an expectation that the contents are effectively eliminated owing to the protruded portions and effectively led owing to the recessed portions, which is a basic characteristic when the protruded portion outermost side assumes an outwardly-convex circular arc in terms of the sectional configuration thereof. Further, as illustrated in FIG. 23, the protruded front edge is formed with the bent area and the second protruded portion lateral side 261 assuming the circular arc, and hence a comparatively good molding configurational retentivity is attained.

Further, this embodiment is suitable for the softer sealed bag 2 (innermost layer) because of the recessed portion opening being larger than in an embodiment (an embodiment 15 which will hereinafter be discussed) of FIG. 24 wherein the construction is substantially the same, but only the number of the protruded portions 21l is different.

[Embodiment 15]

Figure 24:
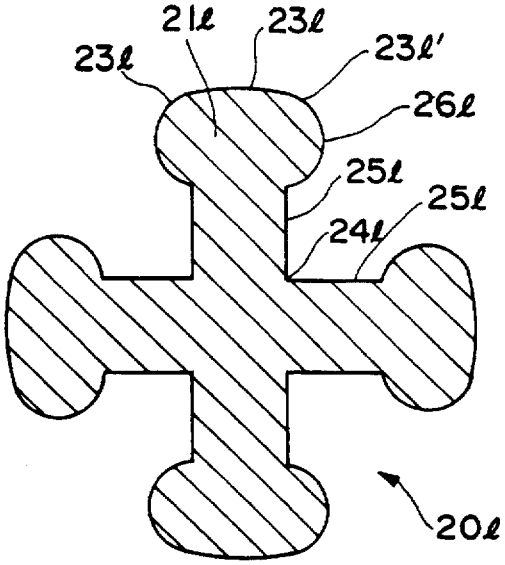
FIG. 24 is a cross-sectional view illustrating a gap holding rod in another embodiment of the present invention.

FIG. 24 is an enlarged cross-sectional view of a gap holding rod in this embodiment, wherein the gap holding rod in the embodiment shown in FIG. 23 is provided with four pieces of protruded portions.

A gap holding rod 20l in this embodiment exhibits substantially the same operation and effect as those in the embodiment of FIG. 23. Because of the recessed portion opening being smaller, however, it is possible to correspond to the softer sealed bag 2 (innermost layer).

Then, as depicted in FIG. 24, similarly the protruded portion is formed with a swelling 28l larger than the recessed portion opening, and consequently there is also no possibility in which the protruded portion of another gap holding rod does not intrude into the recessed portion.

[Embodiment 16]

Figure 25:
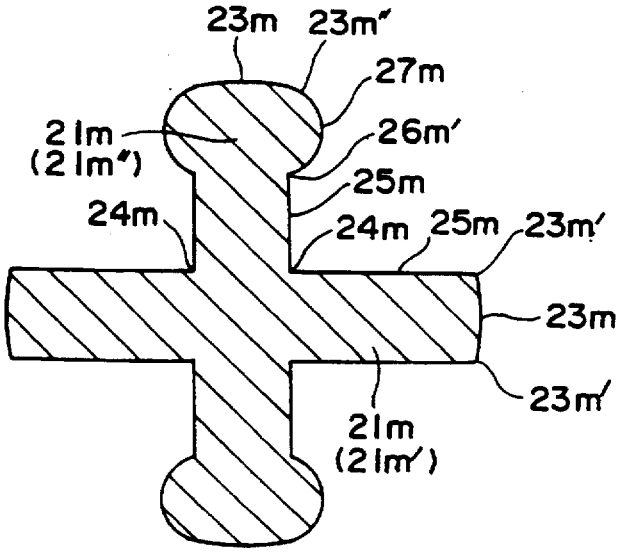
FIG. 25 is a cross-sectional view illustrating a gap holding rod in another embodiment of the present invention.

FIG. 25 is an enlarged cross-sectional view of a gap holding rod 20m in an embodiment 16.

The gap holding rod 20m takes, in terms of the sectional configuration thereof, the following constructions:

(1) One first protruded portion 21m' of adjacent protruded portions 21m has a first protruded portion lateral side 25m extending outward from a proximal point 24m to an edge 23m' of a protruded portion outermost side 23m taking a circular arc substantially in parallel to the protruded portion central line passing through substantially the center of the section of the gap holding rod 20m and the center of the first protruded portion 21m'.

(2) Another second protruded portion 21m" of the adjacent protruded portions has a second protruded portion lateral side 26m extending outward from the proximal point 24m substantially in parallel to the protruded portion central line passing through substantially the center of the section of the gap holding rod 20m and the center of the second protruded portion 21m". The second protruded portion 21m" also has a third protruded portion lateral side 27m extending from an outer edge 26m' of the second protruded portion lateral side 26m and defined as a semicircle having its center at a point in the vicinity of the front edge of the protruded portion 21m' and also its diameter substantially equal to a width of the second protruded portion lateral side 26m of the protruded portion 21m", the third protruded lateral side 27m being, without being bent, contiguous to an edge 23m" of a protruded portion outermost side 23m.

(3) In each protruded portion 21m, the first protruded portion lateral side 25m is contiguous at the proximal point 24m to the second protruded portion lateral side 26m adjacent thereto.

The gap holding rod 20m in this embodiment gives surely such an expectation that the contents are effectively eliminated owing to the protruded portions and effectively led owing to the recessed portions, which is a basic characteristic when the protruded portion outermost side assumes an outwardly-convex circular arc in terms of the sectional configuration thereof as in the embodiment discussed above. Further, the gap holding rod 20m is, as illustrated in FIG. 25, constructed such that the second protruded portion 21m" is contiguous to the first protruded portion 21m' (and vice versa), and the formation in such a way is attainable.

[Embodiment 17]

Next, there will be described an example wherein although other structures of the pump device for the container remain unchanged, the gap holding rod, in terms of the sectional configuration thereof, includes a protruded portion outermost side defined as a straight line unlike the respective embodiments given above. Since other structures of the pump device for the container remain unchanged, an explanation is confined to the gap holding rod.

To start with, there will be explained a gap holding rod, wherein the protruded portion outermost side is defined as a straight line, and other sides are also straight lines.

Figure 26:
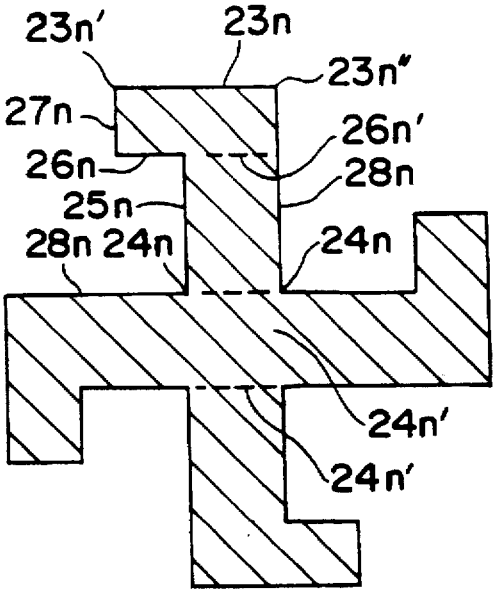
FIG. 26 is a cross-sectional view illustrating a gap holding rod in another embodiment of the present invention.

FIG. 26 is an enlarged cross-sectional view showing one example of a gap holding rod 20n in an embodiment 17.

The gap holding rod 20n takes, in terms of the sectional configuration thereof, the following constructions:

(1) A protruded portion 21n includes first protruded portion lateral sides 25n extending outward from proximal points 24n on one side substantially in parallel to the protruded portion central line passing through substantially the center of the section of the gap holding rod 20n and the center of the protruded portion 21n. The protruded portion 21n also includes second protruded portion lateral sides 26n extending from outer edges of the first protruded portion lateral sides 25n substantially perpendicularly to the protruded portion central line in directions opposite to each other. The protruded portion 21n further includes third protruded portion lateral sides 27n extending perpendicularly from outer edges of the second protruded portion lateral sides 26n to edges 23n' of protruded portion outermost sides 23n defined as the straight lines in parallel to the first protruded portion lateral sides 25n.

(2) The protruded portion 21n includes fourth protruded portion lateral sides 28n extending outward from the proximal points 24n on the other side to other edges 23n" of the protruded portion outermost sides 23n in parallel to the first protruded portion lateral sides 25n.

(3) In each protruded portion 21n, the first protruded portion lateral side 25n is contiguous at the proximal point 24n to the fourth protruded portion lateral side 28n, adjacent thereto, of another protruded portion.

The gap holding rod 20n in this embodiment exhibits the above characteristic when adopting the straight line as the protruded portion outermost side. That is, the gap holding rod 20n can be formed by joining the precast tabular moldings each having six flat surfaces without depending on the contour extrusion molding method.

More specifically, the gap holding rod 20n is, it can be considered, formed by joining seven pieces of the precast tabular moldings each having the six flat surfaces, those moldings being segmented by a line (a broken line 24n' in FIG. 27) connecting the two proximal points 24n and a line (a broken line 26n' in FIG. 27) of the second protruded portion lateral side 26n that is extended enough to reach the fourth protruded portion lateral side 28n.

Further, the above recessed portion has no inward area having its width larger than the opening, and it is therefore possible to adopt a method of cutting inward the precast integral molding such as an angular rod or the like from its outer peripheral portion.

Figure 27:
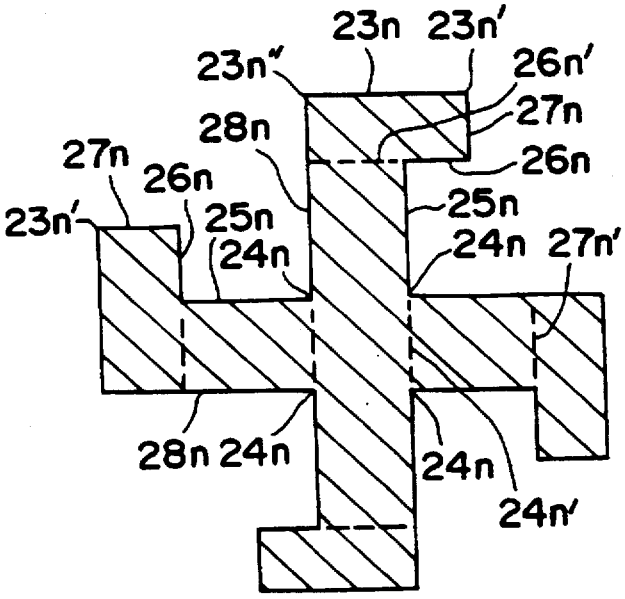
FIG. 27 is a cross-sectional view illustrating a gap holding rod in another embodiment of the present invention.

Note that FIG. 27 is the enlarged cross-sectional view showing the example of the gap holding rod when inverting the gap holding rod 20n of FIG. 26 and internally fitting it into the suction port 17 as viewed in the same direction, wherein this operates the same as that in FIG. 26.

[Embodiment 18]

Next, there will be explained a gap holding rod, wherein the protruded portion outermost side is a straight line, and other sides takes circular arcs or straight lines.

Figure 28:
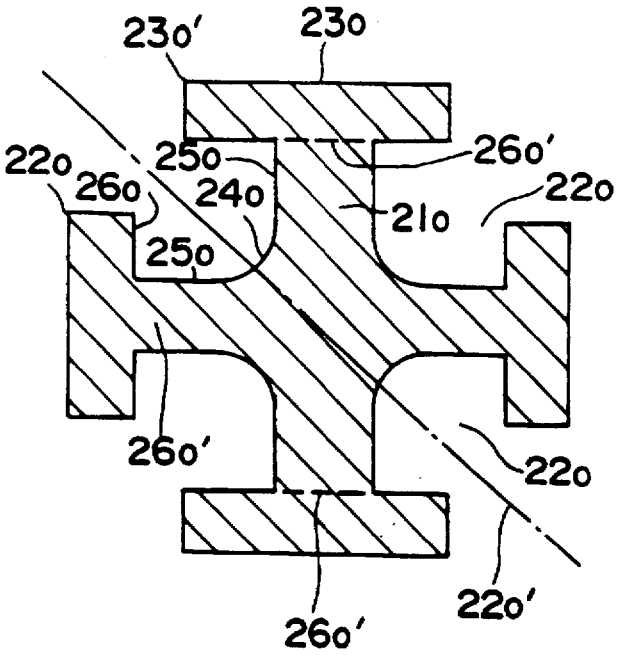
FIG. 28 is a cross-sectional view illustrating a gap holding rod in another embodiment of the present invention.

FIG. 28 is an enlarged cross-sectional view of a gap holding rod 20o in an embodiment 18.

The gap holding rod 20o takes, in terms of the sectional configuration thereof, the following constructions:

(1) The gap holding rod 20o has a recessed portion base 24o assuming a circular arc having its center positioned at a point on a recessed portion bisectrix 22o' passing through the center of the gap holding rod 20o while substantially bisecting an area between two protruded portions 21o adjacent to each other and its radius shorter than the protruded portion 21o.

(2) The protruded portion 21o includes first protruded portion lateral sides 25o contiguous, without being bent, to outer edges of the recessed portion bases 24o and extending outward substantially in parallel to the protruded portion central line passing through substantially the center of the section of the gap holding rod 20o and the center of the protruded portion 21o. The protruded portion 21o also includes second protruded portion lateral sides 26o extending from outer edges of the first protruded portion lateral sides 25o substantially perpendicularly to the protruded portion central line in directions opposite to each other. The protruded portion 21o further includes third protruded portion lateral sides 27o extending perpendicularly from outer edges of the second protruded portion lateral sides 26o to edges 23o' of protruded portion outermost sides 23o defined as straight lines in parallel to the first protruded portion lateral sides 25o.

The gap holding rod 20o in this embodiment partly exhibits the characteristic when adopting the straight line as the above protruded portion outermost side. That is, without depending on the contour extrusion molding method, the gap holding rod 20o is, it can be considered, formed by joining, to a remaining portion inside the above broken line

26*o*' (e.g., a portion formed by cutting the precast angular rod), four pieces of the precast tabular moldings each having the six flat surfaces, each molding being segmented by a line (a broken line 26*o*' in FIG. 28) formed by extending the two second protruded portion lateral sides 26*o* of the protruded portion 21*o* inwardly of the protruded portion enough to connect them to each other.

[Embodiment 19]

Figure 29:
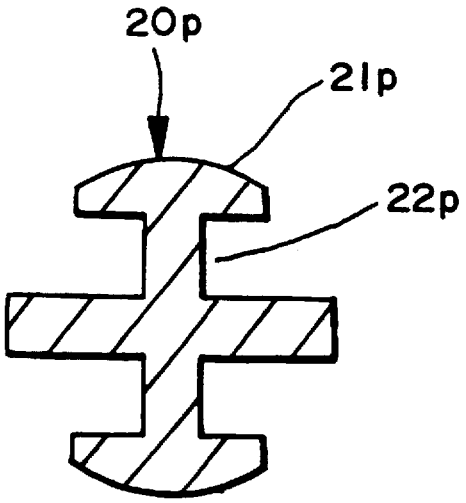
FIG. 29 is a cross-sectional view illustrating a gap holding rod in other embodiment of the present invention.
Figure 30:
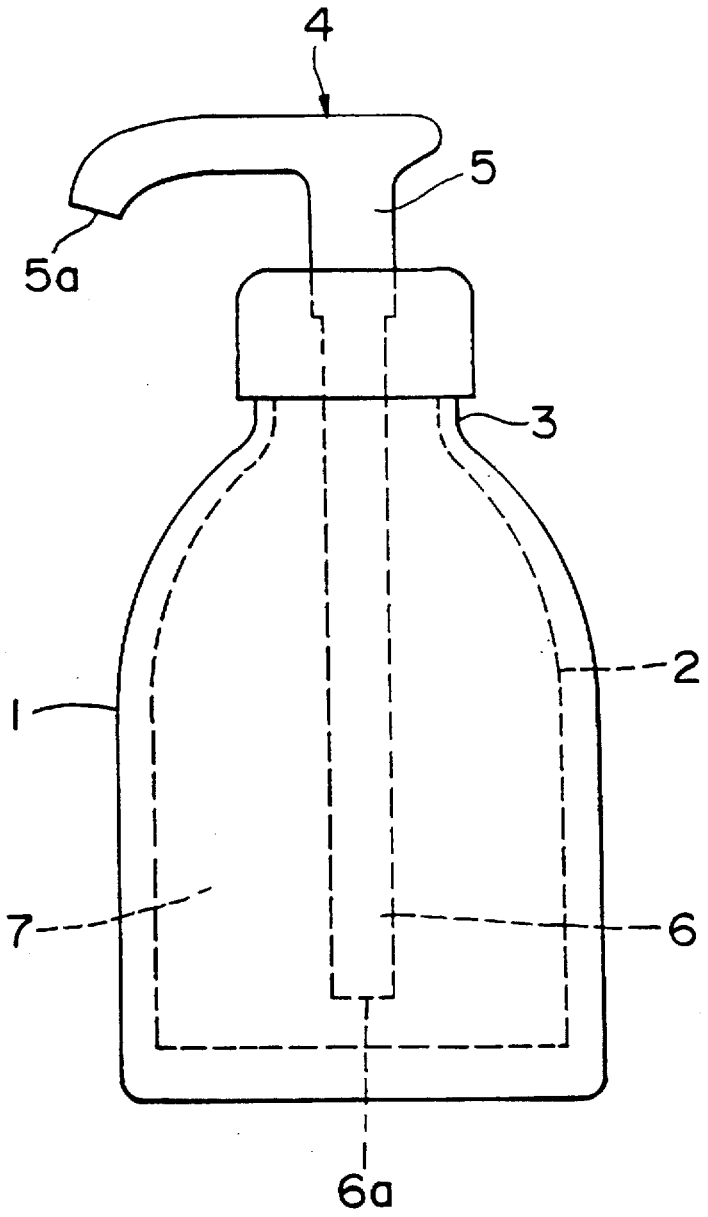
FIG. 30 PRIOR ART
FIG. 30 is an assembly outside view illustrating a pump device and a container in the prior art.

FIG. 29 is an enlarged cross-sectional view of a gap holding rod 20*p* in an embodiment 19.

In the gap holding rod 20*p* in accordance with this embodiment, in terms of the sectional configuration thereof, a protruded portion 21*p* has an outwardly-convex circular arc or a straight line adopted as a protruded outermost side 23*p*.

As illustrated in FIG. 29, the gap holding rod 20*p* assumes a cross-sectional shape that is substantially a double-E the center of which coincides with the center of the cylindrical unit 9 of the suction portion 6.

The gap holding rod 20*p* in this embodiment exhibits, though the protruded portion outermost side takes an outwardly-convex circular arc or the straight line, a characteristic corresponding thereto. Furthermore, the recessed portion 22 has no inward area having its width larger than the opening, and hence, on the occasion of molding, it is possible to used a method of cutting inward the precast integral molding such as an angular rod or the like from its outer peripheral portion.

INDUSTRIAL APPLICABILITY

As discussed above, according to the present invention, the gap holding rod is internally fitted into the suction port and is formed with the protruded portions and the recessed portions. With this construction, the suction port can be invariably kept in the open stage, and, even if the contents-filled sealed bag (or the innermost layer in the laminated container) is closely fitted to the gap holding rod, the passageway for the contents can be secured. Hence, there is produced such an excellent effect that the whole quantity of the contents can be smoothly surely poured out till the contents disappear almost completely.

Then, a variety of effects stated by way of the operations in the discussion on the respective embodiments can be added by changing the sectional configuration of the gap holding rod.

Especially in the example where the protruded portion has a width larger than the opening of the recessed portion of the gap holding rod, if the gap holding rods are brought into close contact with each other, there is eliminated such a possibility that the protruded portion of another gap holding rod is intruded into the recessed portion.

Further, the gap holding rod is formed by contour extrusion and can be used by cutting it to the predetermined length, and hence the productivity is extremely high, whereby the costs can be decreased.

Further, the outer peripheral surface of the suction portion is formed with the grooves, and, with this formation, the passageway for the contents can be secured even when the contents-filled sealed bag (or the innermost layer in the laminated container) is closely fitted into the suction portion. Exhibited consequently is the excellent effect in which substantially the whole quantity of the contents can be certainly smoothly poured out till the contents disappear completely.

What is claimed is:

1. A pump device for a container, used by attaching said pump device to said container having a contents-filled sealed bag contracting with a negative-pressurization of an interior thereof when taking out contents thereof, said pump device comprising:

an operating portion, an upper edge of which is exposed to an outside of said container;

a suction portion having a flange formed in an upper portion thereof and being fixed to said container with a cap screwed onto a cylindrical mouth of said container from above said flange, a lower end of said suction portion being inserted into said container and sucking the contents from a suction port opened at a lower edge of said suction portion, said suction portion having a plurality of cylindrical portions of decreasing diameter starting below said flange, and a piston movable upward and downward within an upper cylindrical portion with the moving of said operating portion, said piston having a piston packing slideably contacting an internal surface of said upper cylindrical portion;

a plurality of first protruded portions and first recessed portions extending along an axial line of said upper cylindrical portion and alternately formed circumferentially on an outer peripheral surface of said upper cylindrical portion;

a plurality of second protruded portions and second recessed portions extending along an axial line of others of said cylindrical portions other than said upper cylindrical portion and alternately formed circumferentially on outer peripheral surfaces of said others of said cylindrical portions;

a gap holding rod having a proximal end internally fitted into said suction port of said suction portion and a distal end extending toward an inner bottom portion of said contents-filled sealed bag; and third protruded portions and third recessed portions extending from said proximal end of said gap holding rod toward said distal end and being alternately formed on an outer peripheral surface of said gap holding rod.

2. The pump device of claim 1, wherein said piston is cylindrically formed and said piston packing is movably mounted to said piston.

* * * * *